United States Patent [19]

Beal et al.

[11] 4,403,218

[45] Sep. 6, 1983

[54] PORTABLE INSTRUMENTATION TELEMETRY DEVICE

[75] Inventors: Terrence E. Beal; Richard W. Boeglin, both of Portsmouth, R.I.

[73] Assignee: The United States of America as represented by the Secretary of the Navy, Washington, D.C.

[21] Appl. No.: 294,263

[22] Filed: Aug. 19, 1981

[51] Int. Cl.[3] ..... G08C 19/16; G08C 19/06; G08C 19/12

[52] U.S. Cl. ..... 340/870.18; 200/80 R; 340/870.17; 340/870.31; 340/870.38; 340/870.39; 374/154

[58] Field of Search ..... 340/870.18, 870.26, 340/870.31, 870.32, 870.17, 870.39, 58, 870.38; 200/80 R; 374/154

[56] References Cited

U.S. PATENT DOCUMENTS

| | | | |
|---|---|---|---|
| 3,668,673 | 6/1972 | Adler | 340/870.26 |
| 3,824,857 | 7/1974 | Smith | 340/870.18 |
| 4,043,076 | 8/1977 | Potrozuski et al. | 200/80 R |
| 4,052,884 | 10/1977 | Milberger | 340/870.18 |
| 4,182,952 | 1/1980 | Moore | 200/80 R |
| 4,225,851 | 9/1980 | Reschovsky et al. | 340/870.18 |
| 4,253,192 | 2/1981 | Donnally et al. | 340/870.31 |

*Primary Examiner*—James J. Groody

*Attorney, Agent, or Firm*—Robert F. Beers; Arthur A. McGill; Prithvi C. Lall

[57] ABSTRACT

A shaft mountable, portable, low frequency FM transmission device for communicating rotating shaft mounted sensor information to a stationary platform. It includes a generally cylindrical, dynamically balanced sending unit attached to and encircling the shaft and a remote stationary receiver having a preamplifier and pickup loop encircling but not touching the sending unit. Information from shaft mounted transducers is transmitted from the shaft to the receiver using low frequency FM techniques. Low frequency FM operates at low power which permits use of small batteries containable in a reduced volume, requires minimal receiver electronics, allows undistorted signal transmission at high RPM's and is relatively insensitive to axial and radial shaft movement.

7 Claims, 3 Drawing Figures

PORTABLE INSTRUMENTATION TELEMETRY DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to information transmission from remote sensors mounted on a rotating shaft and more particularly to a portable, battery powered, instrumentation telemetry device, mounted on a rotating shaft. This device transmits a low frequency FM signal containing information obtained from the rotating shaft sensors without requiring a contact dependent coupling to the stationary platform which would restrict the shaft's radial or axial movement or contributing any unbalanced loads to the rotating shaft, especially at high shaft RPM's.

(2) Description of the Prior Art

Several methods have been used in the past to obtain real time information, such as torque, from a rotating shaft. Methods used include: strain gages with slip rings, optical devices, variable inductance transformers, and FM-FM transmitters where a high frequency FM signal is superimposed on an FM carrier.

Each of these methods has a disadvantage. Strain gages with slip rings restrict radial and axial movement or require the use of a floating bearing for brush mounting. Slip rings also introduce unwanted noise into the system and currently limit the maximum rotational velocity to 5000 feet per minute (fpm). Optical devices require very precise alignment and cannot tolerate axial or radial shaft movement. Variable inductance methods require close tolerances around the circumference of the rotating device and cannot tolerate radial movement. The FM-FM technique has been by far the most versatile approach to date. However, because it must operate at a very high frequency, the FM-FM transmitter is very susceptible to frequency instability due to capacitance and inductance variations caused by component flexture at high RPM. Encapsulation of existing devices has only partially mitigated these problems. In addition existing FM-FM devices are available only as strap-on hardware and as such introduce rotational imbanace into the system. FM-FM techniques also require the use of complex FM-FM receivers presently available only in large, rack-mount sizes.

SUMMARY OF THE INVENTION

This invention provides a device which mounts around and attaches to a rotating shaft, which device includes a cylindrical, dynamically balanced sending unit encircling the shaft and a remote stationary receiver having a pickup loop encircling but not touching the sending unit. Information from shaft mounted sensors is transmitted from the shaft via the sending unit antenna loop to the stationary receiver pickup loop using low frequency FM techniques. In this way information is obtained from the rotating shaft without imparting imbalance or constraining radial or axial movement. Low frequency FM requires low power to operate, thus permitting use of smaller batteries (which are containable in a smaller volume) and minimal receiver electronics. It also allows undistorted signal transmission at high RPM's. Battery saver centrifugal switches provide automatic circuit shutoff, except when the shaft is rotating, thereby extending battery life.

Accordingly, an object of subject invention is to use low frequency FM techniques to transmit sensing transducer (such as strain gages, thermocouples, etc.) information from an isolated rotating shaft to a stationary platform.

Another object of subject invention is to transmit information obtained from a rotating shaft without having to couple to a stationary platform in such a way as to restrict the movement of or add an unbalanced load to the rotating shaft.

Still another object of subject invention is to have weighted centrifugal switches in series which render the sending unit in an "off" state at all angular positions until the unit is activated by shaft rotation closing the switches.

A still further object of subject invention is to have a dynamically balanced sending unit mountable on the rotating shaft without shaft equipment disassembly which balanced unit avoids introducing rotational imbalance to the system.

Other objects, advantages, and novel features of this invention will become apparent from the following detailed description of the invention when considered in conjunction with the accompanying drawings herein.

DESCRIPTION OF THE PREFERRED EMBODIMENT

Figure 1:
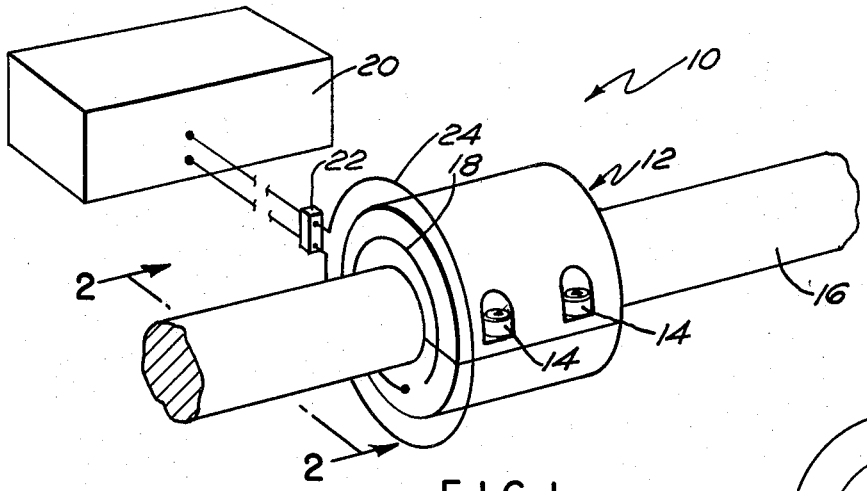
FIG. 1 shows an isometric view of a device built according to the teachings of subject invention.

Referring now to FIG. 1 there is shown a device built according to the teachings of subject invention. A portable instrumentation telemetry device 10 comprises a dynamically balanced sending unit 12, cylindrical in shape, encircling and fixedly attached by screws 14 to rotating shaft 16. Sending unit 12 has a loop type antenna 18 mounted on one end, which antenna also generally encircles rotating shaft 16. A receiver 20, remote from rotating shaft 16, is connected to preamplifier 22 and stationary pickup loop antenna 24, which encircles but does not touch sending unit 12. Information is transmitted from transducer sensors attached to rotating shaft 16 via sending unit 12 and preamplifier 22 to receiver 20 using relatively low frequency, direct FM techniques.

Figure 2:
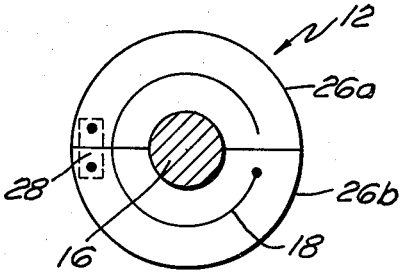
FIG. 2 shows an end-view of the sending unit of the device shown in FIG. 1, taken along line 2—2.

FIG. 2 is an end view of sending unit 12. This sending unit, an assembly of semicircular cylinder sections **26*a* and 26*b*, is attached around shaft 16 while the shaft remains in place in the system it forms part of. A bypass connection 28 is provided to allow in-place calibration of the internal electronic circuit of sending unit 12** using jumper means.

Figure 3:
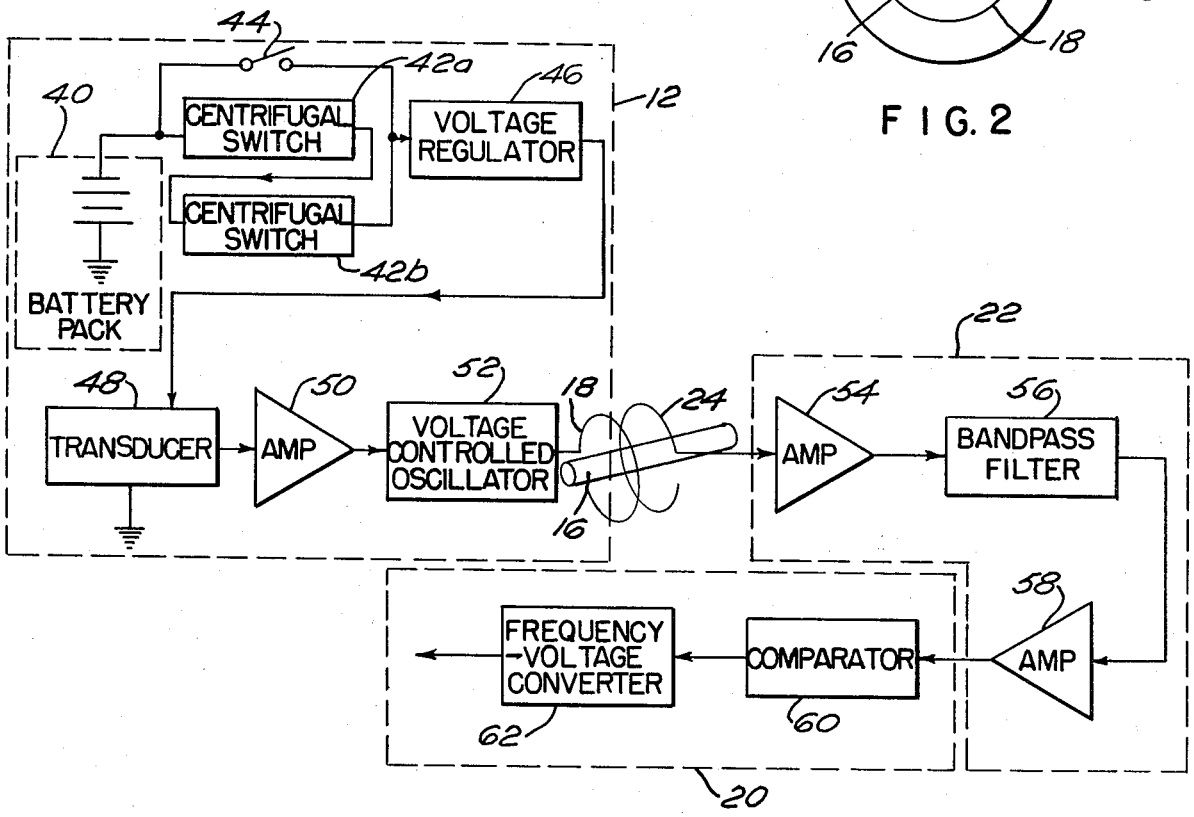
FIG. 3 shows a block diagram of the circuits of a device built according to the teachings of subject invention.

FIG. 3 shows the block diagrams of sending unit 12, receiver 20 and preamplifier 22. Sending unit 12 comprises battery power supply 40, weighted, series connected centrifugal switches **42*a* and 42*b*, external jumper 44 (which can span bypass connection 28), voltage regulator 46, transducer 48, differential amplifier 50, linear voltage-controlled oscillator 52 and transmitting loop antenna 18 all enclosed in a dual segment housing which has been dynamically balanced. Preamplifier 22 comprises pickup loop antenna 24, headstage amplifier 54, bandpass filter 56 and amplifier 58. Receiver 20 comprises comparator 60 and frequency-to-voltage converter 62**.

Within sending unit 12, regulated voltage produced by regulator 46 is provided to transducer 48 only when weighted centrifugal switches 42*a* and 42*b* close due to shaft 16 rotation. The modulated voltage output of transducer 48 is next fed into differential amplifier 50. The output amplifier 50 drives linear voltage-controlled oscillator 52, the output of which is transmitted by antenna loop 18 as a direct FM signal. It should be noted that external jumper 44 allows static calibration of the electronic circuits of sending unit 12.

In preamplifier 22, loop atenna 24 receives the output FM signal of sending unit 12 which is then amplified and filtered by headstage amplifier 54 and bandpass filter 56 to eliminate unwanted high and low frequency noise. The resulting signal output of bandpass filter 56 is then amplified in amplifier 58.

Within receiver 20, the output of preamplifier 22 is passed to comparator 60 which converts the signal to a Transistor/Transistor Logic (TTL) compatible square wave. The square wave output of comparator 60 is then converted back to a DC voltage level by frequency-to-voltage converter 62. This DC voltage represents the final output of device 10 and is directly proportional to the shaft 16 induced input to transducer 48.

The invention described supra is portable, lightweight, and compact. Sending unit 12, built as two semicircular halves, is easily attached to the shaft of interest without having to disassemble the equipment which the shaft forms a part of. The use of low frequency FM transmission between two loop type antennas eliminates the previous 5000 fpm rotational velocity limitations imposed by brush bounce generated noise, slip ring design and nonlinearity of receiver output from FM-FM transmission. The linearity of the receiver output of the instant invention is also insensitive to axial and/or radial shaft movement causing relative antenna position movement in that device 10 uses direct low frequency FM with linear 40% deviation. Such linearity is achieved by use of an analog multiplexer integrated circuit (IC), i.e., a solid state relay, as a pair of matched Field Effect Transistors (FET's), same substrate, for use as Voltage Controlled Rectifiers (VCR's) in a phase shift oscillator. Battery saver centrifugal switches provide automatic circuit shutoff, except when the shaft is rotating, thereby prolonging the useful life of the battery. The battery is readily removable when replacement is necessary. Almost any transducer can be used as a sensor, allowing measurement of temperature, low frequency vibration, torque, strain, etc. The low power operation of the low frequency FM sending unit permits use of smaller batteries and minimal electronics designed around a single quad-OP AMP IC resulting in a simple, low cost, highly reliable device. The sending unit is dynamically balanced around its major cylindrical axis to prevent stress and vibration in the shaft due to the attached unit.

What has thus been described is a shaft mountable, portable, FM transmission transducer device for communication rotating shaft mounted sensor information to a stationary platform, which device includes a generally cylindrical, dynamically balanced sending unit encircling and attached to the shaft, a preamplifier having a pickup loop encircling but not touching the sending unit and a remote stationary receiver. Information from shaft mounted transducers is transmitted from the shaft to the receiver using low frequency FM techniques, which require low power to operate thus requiring smaller batteries containable in a smaller volume together with minimal receiver electronics. Low frequency FM also allows undistorted signal transmission at high RPM's. Because of the high frequency response of the system, dynamic information such as shock, vibration, etc., may be transmitted from the shaft of interest as well.

Obviously, many modifications and variations of the present invention are possible in light of the above teachings. For example, the present device could be used in biomedical instrumentation due to its electrical isolation. The shape and number of turns of the loop antennas are not critical. Exact hardware and techniques used may vary depending on physical location and transducer type. The electronics could also be fabricated as a hybrid integrated circuit allowing a much more compact design. It is therefore understood that within the scope of the appended claims the invention may be practiced otherwise than specifically described.

What is claimed is:

1. A portable instrumentation telemetry device for receiving D.C. voltage output signals from a remote sensor adapted to respond to local environmental parameter changes such that the output voltage thereof varies in proportion thereto, said sensor being mounted on a rotatable shaft and for transmitting said sensor output signals to a stationary receiving station, said device comprising:

sending unit means further comprising a cylindrical, severable housing fixedly attachable to said rotatable shaft; battery means, mounted within said housing, for providing D.C. power to said sending unit means; centrifugal switch means connected to said battery means for transmitting said D.C. power from said battery means only when said rotatable shaft is turning; voltage regulator means connected to said centrifugal switch means and said sensor for receiving said D.C. power from said centrifugal switch means, regulating the voltage level thereof and transmitting said regulated D.C. power from said voltage-regulator means to said shaft mounted sensor whereupon said sensor modulates said D.C. voltage in proportion to said environmental parameter changes to be measured; first amplifier means, connected to said remote sensor, for receiving and amplifying the modulated D.C. voltage output of said remote sensor; voltage-controlled oscillator means, connected to said first amplifier means, for receiving the modulated voltage output of said first amplifier means and converting said amplifier output to a proportional direct FM signal voltage output; and first loop antenna means, connected to said oscillator means, for transmitting said output of said voltage-controlled oscillator means as said direct FM signal, said sending unit means being fixedly attached to and dynamically balanced about the primary axis of said rotatable shaft, and connected to said sensor, for receiving said sensor output signals and transmitting direct FM signals proportional to said sensor output signals;

preamplifier means, being generally stationary and located in close proximity to said sending unit means, for receiving, amplifying and bandpass filtering said direct FM signal from said sending unit means in such a way as to produce an FM signal proportional to said sensor output signal; and receiver means, connected to said preamplifier means, for receiving said proportional FM signal from said preamplifier means and converting said proportional FM signal to a D.C. voltage equivalent of said sensor output D.C. voltage.

2. A portable instrumentation telemetry device according to claim 1 wherein said preamplifier means further comprises:

second loop antenna means for receiving said direct FM signal transmitted from said first loop antenna means;

second amplifier means connected to said second loop antenna means, for receiving and amplifying said direct FM signal output of said second loop antenna means and producing a direct proportional FM signal therefrom;

bandpass filter means, connected to said second amplifier means, for receiving and filtering said direct FM signal output of said second amplifier means; and third amplifier means, connected to said bandpass filter means, for receiving and amplifying said filtered output of said bandpass filter means.

3. A portable instrumentation telemetry device according to claim 2 wherein said receiver means further comprises:

comparator means, connected to said third amplifier means, for receiving and converting the filtered output of said third amplifier means to a TTL compatible FM square wave output; and frequency-voltage converter means, connected to said comparator means, for receiving and converting said TTL compatible FM square wave output of said comparator means to a proportional D.C. voltage signal, said D.C. voltage signal being proportional to said modulated D.C. voltage output of said remote sensor.

4. A portable instrumentation telemetry device according to claim 3 wherein said remote sensor further comprises a strain gage.

5. A portable instrumentation telemetry device according to claim 3 wherein said said remote sensor further comprises a thermocouple.

6. A portable instrumentation telemetry device according to claim 4 wherein said centrifugal switch means further comprises:

a plurality of centrifugal switches connected together in a series arrangement; and bypass means, connected so as to bypass the series arrangement of centrifugal switches, for providing a calibration mode for said sending unit means while said sending unit means remains affixed to said rotatable shaft.

7. A portable instrumentation telemetry device according to claim 5 wherein said centrifugal switch means further comprises:

a plurality of centrifugal switches connected together in a series arrangement; and bypass means, connected so as to bypass the series arrangement of centrifugal switches, for providing a calibration mode for said sending unit means while said sending unit means remains affixed to said rotatable shaft.

* * * * *